US006722066B1

(12) United States Patent
Cheung

(10) Patent No.: US 6,722,066 B1
(45) Date of Patent: Apr. 20, 2004

(54) SINGLE AND MULTIPLE ILLUMINATED IMAGES

(76) Inventor: James Cheung, 37-48 78th St., Jackson Heights, NY (US) 11372

( * ) Notice: Subject to any disclaimer, the term of this patent is extended or adjusted under 35 U.S.C. 154(b) by 0 days.

(21) Appl. No.: 10/105,564

(22) Filed: Mar. 25, 2002

(51) Int. Cl.[7] ..... G09F 3/04
(52) U.S. Cl. ..... 40/581; 40/580; 40/444
(58) Field of Search ..... 40/544, 444, 581, 40/580

(56) References Cited

U.S. PATENT DOCUMENTS 2,863,240 A * 12/1958 Glukes ..... 40/444
3,997,991 A * 12/1976 Hayman-Chaffey et al. .. 40/443
5,005,306 A * 4/1991 Kinstler ..... 40/544

* cited by examiner

*Primary Examiner*—Cassandra H. Davis
(74) *Attorney, Agent, or Firm*—Michael I Kroll

(57) ABSTRACT

Disclosed is an apparatus for displaying at least one image by applying the image to a transparent substrate and portraying the image using one or more colored translucent substances limited to specific wavelengths of the visible light spectrum substantially matching the color of the transparent substrate and treating the non-image area on the transparent substrate with an opaque substance.

2 Claims, 13 Drawing Sheets

SINGLE AND MULTIPLE ILLUMINATED IMAGES

BACKGROUND OF THE INVENTION

1. Field of the Invention

The present invention relates generally to illuminated displays and, more specifically, to an apparatus for displaying at least one image by applying said image to a transparent substrate and portraying said image using a colored translucent substance limited to a specific wavelength of the visible light spectrum and treating the non-image area on the transparent substrate with an opaque substance.

Furthermore, selectively exposing said image carrying transparent substrate to a device generating the aforementioned specific wavelength whereby the image will be viewable through the image carrying material for a selected period of time determined by the period of time that the image carrying material is subjected to the specific wavelength generating device.

2. Description of the Prior Art

There are other illuminated sign devices having and image forming an integral part of a substrate and having illuminating devices placed to as to project light rays causing the image to be visually displayed.

While these illuminated sign devices may be suitable for the purposes for which they were designed, they would not be as suitable for the purposes of the present invention, as hereinafter described.

Therefore it is felt that a need exists for an illuminating sign device having a transparent member with an image or multiple images formed by translucent elements being of a specific visible light wavelength whereupon illumination by a light source having the same visible light wavelength will cause the image of that wavelength to be visually displayed and any other image of a different wavelength will not be displayed until illuminated by that image's particular visible light wavelength.

SUMMARY OF THE PRESENT INVENTION

The invention is an apparatus for displaying one or more illuminated images. The image can be printed or outlined on paper, acetate or plastic film. The printed image, artwork, lettering, slogan, trademark, etc. would be clear, printed with translucent ink or a color-tinted filter. The area surrounding the image would be opaque, not allowing any light through. A lighting source when illuminated would pass through the translucent image and be blocked by the opaque material.

The image can be printed on any suitable material giving the most effective image detail and illumination. For example, a clear plastic film can be used with the image depicted using translucent ink and the area surrounding the image is opaque. The image would be printed inverted on one side of the clear film. To hide the image a semi-translucent paper, ink or paint would be applied to the other side. The image would not be visible until illuminated. To illuminate the image a light source would be energized on the image carry inside. Thereby illuminating the image through the plastic film with the opaque material blocking all other light.

For multiple images on the same strip of film, two or more translucent colors would be needed. Any wavelength of light source can be used. For example a red led and a green led. One image would be printed over the other image; other areas where no lights are to be transmitted through would be opaque. In certain parts where the second image directly overlaps the first image would be clear; no color is needed. When the red led is illuminated the first image in translucent red would be visible on the other side of the filmstrip. Once the red led shuts off, the green led would be illuminated and the second image in translucent green would then illuminate showing detail of a green image. To achieve this multiple color effect, the translucent color would need to be in a certain shade or tone that would only allow to pass through the same shade of color as the light source. The translucent material would only allow the same color through but absorbing all other colors in a natural spectrum. Thereby when the red led is illuminated only the image that is in translucent red would be visible and not the image that is done in green. The same would be true when the green led is illuminated only the image that is in translucent green would be easily visible and not any others.

For an added effect, you can position more than one image to display a message or promote brand names. If multiple images were in various sizes it would appear to be growing or shrinking. There are many appearances and effects that can be achieved in the business of graphics.

A primary object of the present invention is to provide a selectively illuminated image display.

Another object of the present invention is to provide a selectively illuminated image display comprised of at least one image.

Yet another object of the present invention is to provide a selectively illuminated image display comprised of more than one image.

Still yet another object of the present invention is to provide a selectively illuminated image display having a plurality of bulbs that can generate a substantially unique visible light wavelength.

A further object of the present invention is to provide a selectively illuminated image display having a first plurality of bulbs that can generate a first substantially unique visible light wavelength and a second plurality of bulbs that can generate a second substantially unique visible light wavelength.

A yet further object of the present invention is to provide a selectively illuminated image display having a transparent substrate for placing an image thereon.

A still yet further object of the present invention is to provide a selectively illuminated image display having an image portrayed in a colored translucent media.

Another object of the present invention is to provide a selectively illuminated image display having a colored translucent media that may be comprised of a tinted translucent filter.

Yet another object of the present invention is to provide a selectively illuminated image display having a colored translucent media that may be comprised of a colored translucent ink.

Still yet another object of the present invention is to provide a selectively illuminated image display having an image portrayed in more than one colored translucent media.

A further object of the present invention is to provide a selectively illuminated image display having more than one colored translucent media that may be comprised of more than one tinted translucent filter.

A yet further object of the present invention is to provide a selectively illuminated image display having more than one colored translucent media that may be comprised of more than one colored translucent ink.

A still yet further object of the present invention is to provide a selectively illuminated image display having a translucent substrate with an image comprised of a colored translucent media portrayed thereon.

Another object of the present invention is to provide a selectively illuminated image display having a translucent substrate with an image comprised of a colored translucent media portrayed thereon wherein said colored translucent media is a tinted translucent filter.

Yet another object of the present invention is to provide a selectively illuminated image display having a translucent substrate with an image comprised of a colored translucent media portrayed thereon wherein said colored translucent media is translucent ink.

Still yet another object of the present invention is to provide a selectively illuminated image display having a translucent substrate with an image comprised of more than one colored translucent media portrayed thereon wherein said more than one colored translucent media is comprised of abutted tinted translucent filters forming a single planar image.

A further object of the present invention is to provide a selectively illuminated image display having a translucent substrate with an image comprised of more than one colored translucent media portrayed thereon wherein said more than one colored translucent media is comprised of abutted translucent inks forming a single planar image.

A yet further object of the present invention is to provide a selectively illuminated image display having a translucent substrate with an image comprised of a colored translucent media portrayed thereon.

A still yet further object of the present invention is to provide a selectively illuminated image display having a plurality of bulbs capable of generating a specific light wavelength positioned behind a translucent substrate having an image comprised of a colored translucent media portrayed on said wall wherein said colored translucent media is a tinted translucent filter.

Another object of the present invention is to provide a selectively illuminated image display having a plurality of bulbs capable of generating a specific light wavelength positioned behind a translucent substrate having an image comprised of a colored translucent media portrayed on said wall wherein said colored translucent media is translucent ink.

Yet another object of the present invention is to provide a selectively illuminated image display having a plurality of first bulbs capable of generating a specific light wavelength and a plurality of second bulbs capable of generating a different specific light wavelength positioned behind a translucent substrate having an image comprised of more than one colored translucent media portrayed on said wall wherein said more than one colored translucent media is comprised of abutted tinted translucent filters forming a single planar image.

Still yet another object of the present invention is to provide a selectively illuminated image display having a plurality of first bulbs capable of generating a specific light wavelength and a plurality of second bulbs capable of generating a different specific light wavelength positioned behind a translucent substrate with an image comprised of more than one colored translucent media portrayed on said wall wherein said more than one colored translucent media is comprised of abutted translucent inks forming a single planar image.

A further object of the present invention is to provide a selectively illuminated image display having a plurality of bulbs capable of generating a specific light wavelength positioned behind a translucent substrate having an image comprised of a colored translucent filter whereupon energizing said bulbs will cause said image to be visually displayed through said translucent media.

A yet further object of the present invention is to provide a selectively illuminated image display having a plurality of bulbs capable of generating a specific light wavelength positioned behind a translucent substrate having an image comprised of a colored translucent ink whereupon energizing said bulbs will cause said image to be visually displayed through said translucent media.

A still yet further object of the present invention is to provide a selectively illuminated image display having a plurality of first bulbs capable of generating a specific light wavelength and a plurality of second bulbs capable of generating a different specific light wavelength positioned behind a translucent substrate having an image comprised of more than one colored translucent media portrayed on the opposing surface wherein said more than one colored translucent media is comprised of abutted tinted translucent filters forming a single planar image. Upon energizing said first bulbs will cause a portion of said image to be visually displayed through said translucent media while the remainder of the image absorbs or block the lightwaves generated by said first bulbs. Upon energizing said second bulbs will cause the remaining portion of said image to be visually displayed through said translucent media while the first image and opaque areas absorbs or block the lightwaves generated by said second bulbs.

Another object of the present invention is to provide a selectively illuminated image display having a plurality of first bulbs capable of generating a specific light wavelength and a plurality of second bulbs capable of generating a different specific light wavelength positioned behind a translucent substrate with an image comprised of more than one colored translucent media portrayed on said opposing surface wherein said more than one colored translucent media is comprised of abutted translucent inks forming a single planar image. Upon energizing said first bulbs will cause a portion of said image to be visually displayed through said translucent ink while the remainder of the image absorbs or block the lightwaves generated by said first bulbs. Upon energizing said second bulbs will cause the remaining portion of said image to be visually displayed through said translucent ink while the first inked image and opaque areas absorbs or block the lightwaves generated by said second bulbs.

Yet another object of the present invention is to provide a selectively illuminated image display having a multiple image whereupon the overlapping area of the first and second image have no translucent media thereon. So that when the first bulbs are illuminated the specific wavelength of the bulbs and matching translucent media will be displayed. When the second bulbs are illuminated the specific wavelength of said seconds bulbs and matching translucent media will be displayed.

Still yet another object of the present invention is to provide a selectively illuminated image display having a translucent covering over the illuminated image display whereby the image will be unobservable during the times of non-illumination.

Additional objects of the present invention will appear as the description proceeds.

The present invention overcomes the shortcomings of the prior art by providing a selectively illuminated displays for displaying at least one image by applying said image to a transparent substrate and portraying said image using a colored translucent substance limited to a specific wavelength of the visible light spectrum and treating the non-image area on the transparent substrate with an opaque substance.

Furthermore, selectively exposing said image carrying transparent substrate to a device generating the aforementioned specific wavelength whereby the image will be viewable through the image carrying material for a selected period of time determined by the period of time that the image carrying material is subjected to the specific wavelength generating device.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

LIST OF REFERENCE NUMERALS UTILIZED IN THE DRAWINGS

Turning now descriptively to the drawings, in which similar reference characters denote similar elements throughout the several views, the Figures illustrate the single and multiple illuminated images of the present invention. With regard to the reference numerals used, the following numbering is used throughout the various drawing figures.

10 illuminated image display
12 transparent substrate
14 bulb opposing side of transparent substrate
16 exterior side of transparent substrate
18 translucent media
20 translucent filter
22 first translucent filter
24 second translucent filter
26 red translucent filter
28 green translucent filter
30 translucent ink
32 first translucent ink
34 second translucent ink
36 red translucent ink
38 green translucent ink
40 clear image area
42 opaque material
44 image
46 first image
48 second image
50 image abutment
52 visible light rays
54 light source
56 first light source
58 second light source
60 first light source light rays
62 second light source light rays
64 filtered light rays
66 first filtered light rays
68 second filtered light rays
70 translucent covering

BRIEF DESCRIPTION OF THE DRAWING FIGURES

In order that the invention may be more fully understood, it will now be described, by way of example, with reference to the accompanying drawing in which.

DETAILED DESCRIPTION OF THE PREFERRED EMBODIMENT

The following discussion describes in detail one embodiment of the invention (and variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Figure 1:
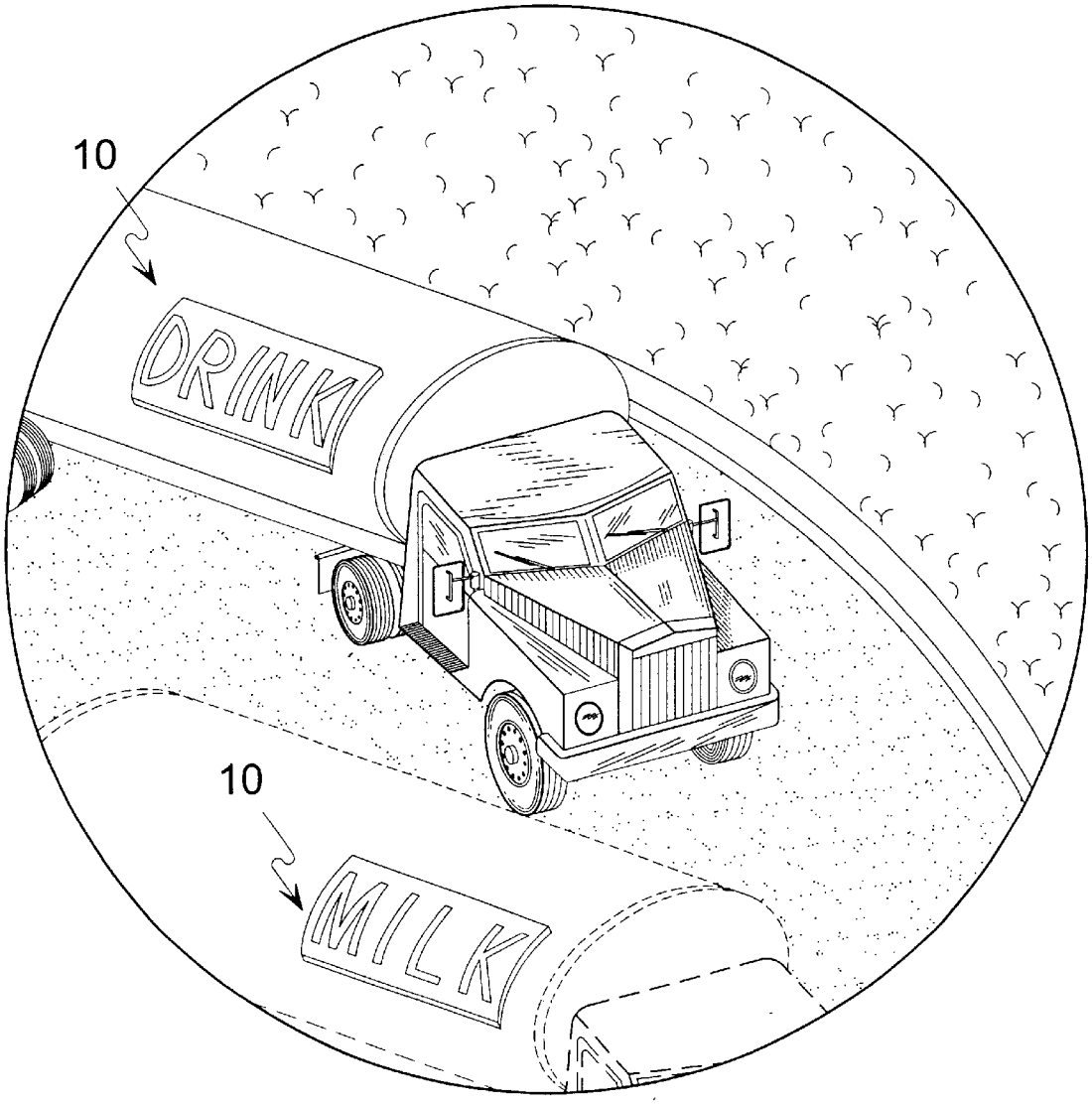
FIG. 1 is an illustrative view of the present invention.

FIG. 1 is an illustrative view of the present invention. Shown is the present invention installed in the side of a truck to provide a multiple color illuminated display whereby the color and message of the display may be changed selectively and periodically, using multiple color tones of film and colored light sources.

Figure 2:
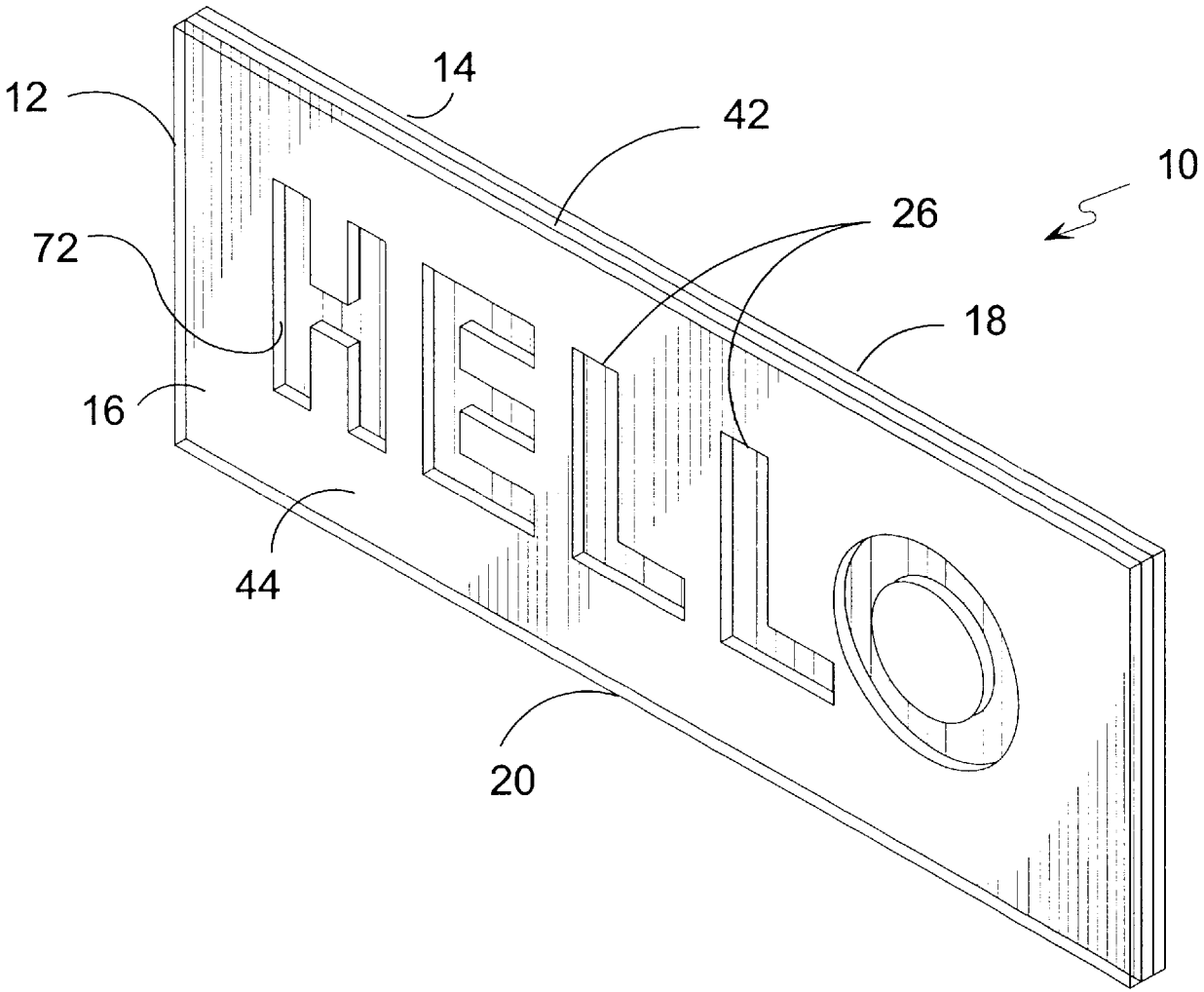
FIG. 2 is a perspective view of the present invention.

FIG. 2 is a perspective view of the present invention. Shown is the present invention composed of a plurality of layers with said layers being, a layer of light filtering color tinted film to allow the passage and illumination thereof only preselected colors and hues, a layer of opaque light restricting material to shape or restrict the viewable surface of the color tinted film through its apertures and a clear sheet of transparent film to protect the opaque layer and its apertures from the elements and exposure.

Figure 3:
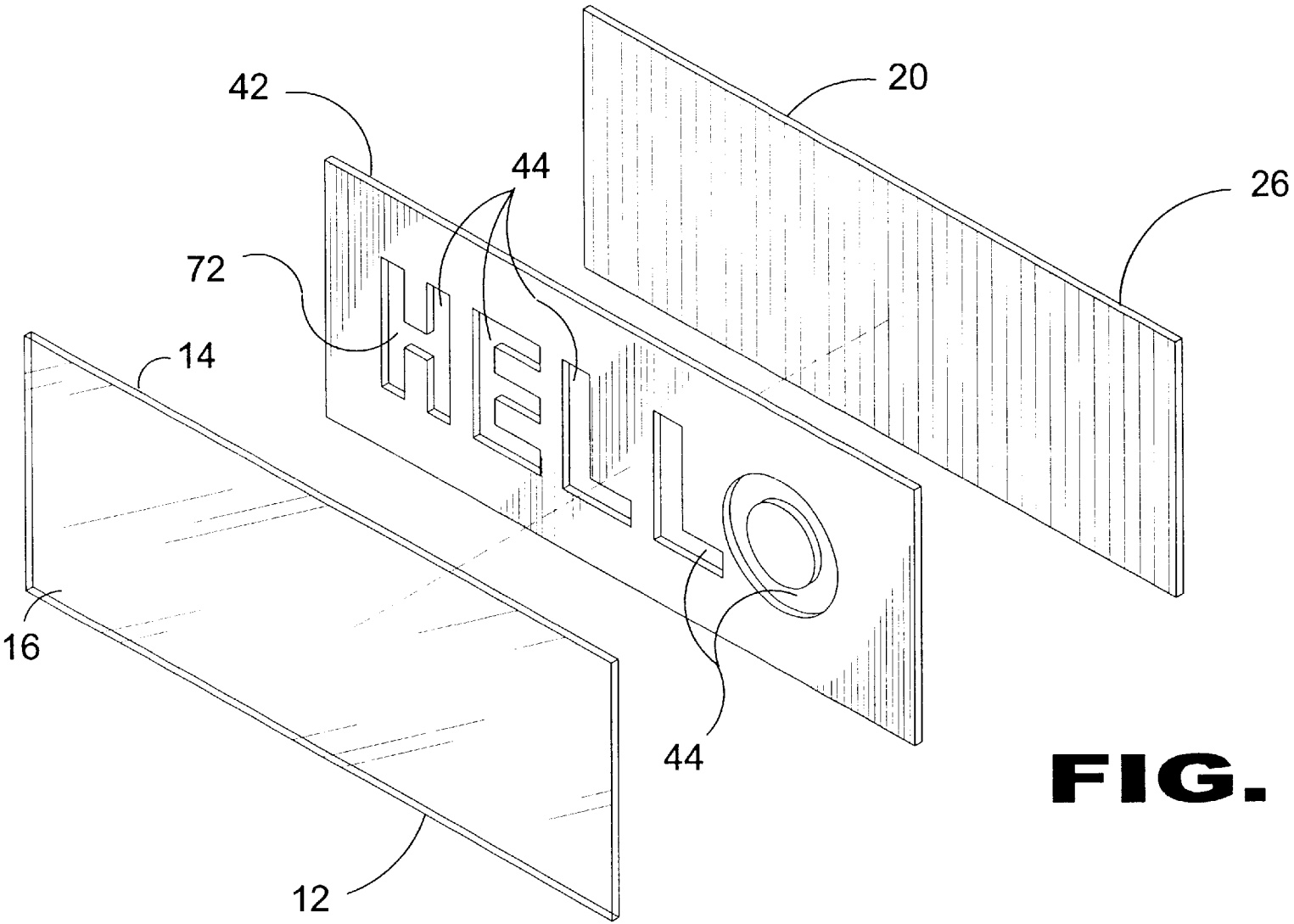
FIG. 3 is an exploded view of the present invention.

FIG. 3 is an exploded view of the present invention. Shown is the present invention exploded apart into its individual layers having a layer of color tinted film applied to the back side portion of the opaque layer so the color tinted film may only be exposed and viewed through the shaped apertures made in the opaque layer's surface.

Figure 4:
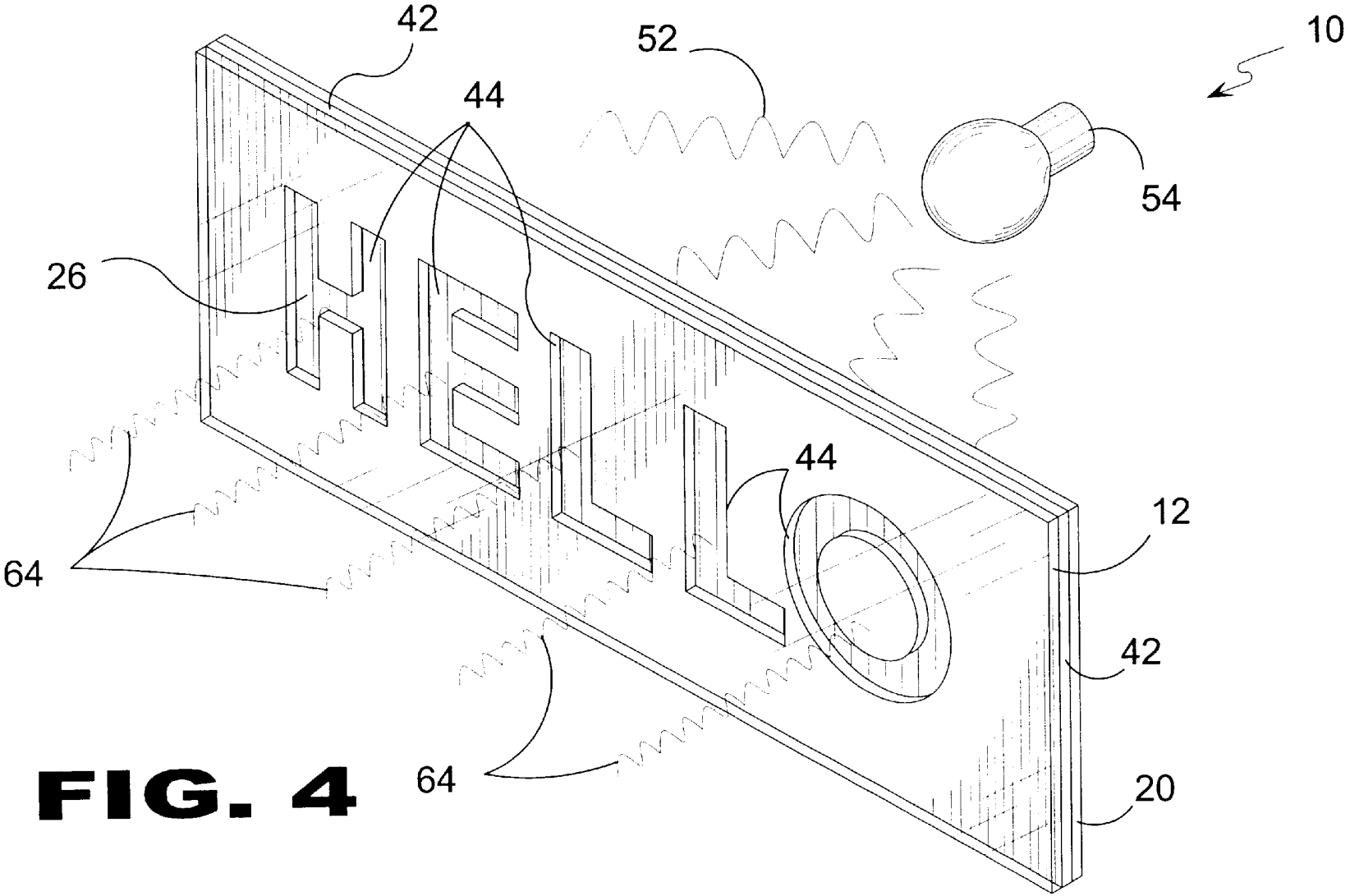
FIG. 4 is a perspective view of the present invention.

FIG. 4 is a perspective view of the present invention. Shown is the present invention having a colored light source emitting light that is restricted to a particular range of the spectrum wherein the light emitted passes through a color tinted film layer that filters and allows the passage of only a specific preselected color of light wave that is then restricted to only pass though the opaque layers apertures.

Figure 5:
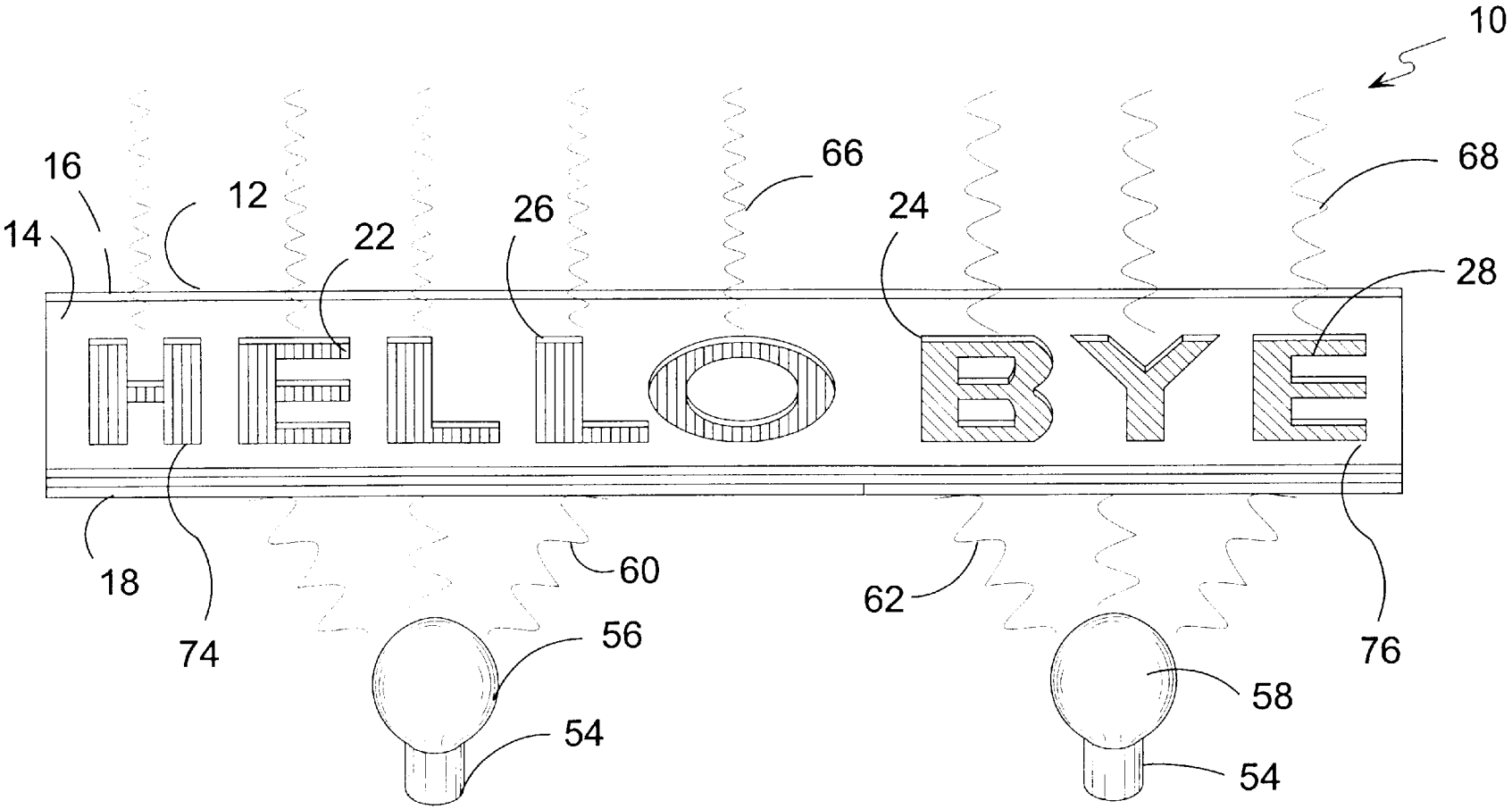
FIG. 5 is a perspective view of the present invention.

FIG. 5 is a perspective view of the present invention. Shown is the present invention having two differently colored light sources with two differently tinted layers of film to provide a system of illuminating different sets of apertures at a time, or in conjunction, with differentiating colors hues of illumination for each set of apertures also shown is the color tinted film layers only allowing color of its preselected tint to pass without the interference from the other colored light sources.

Figure 6:
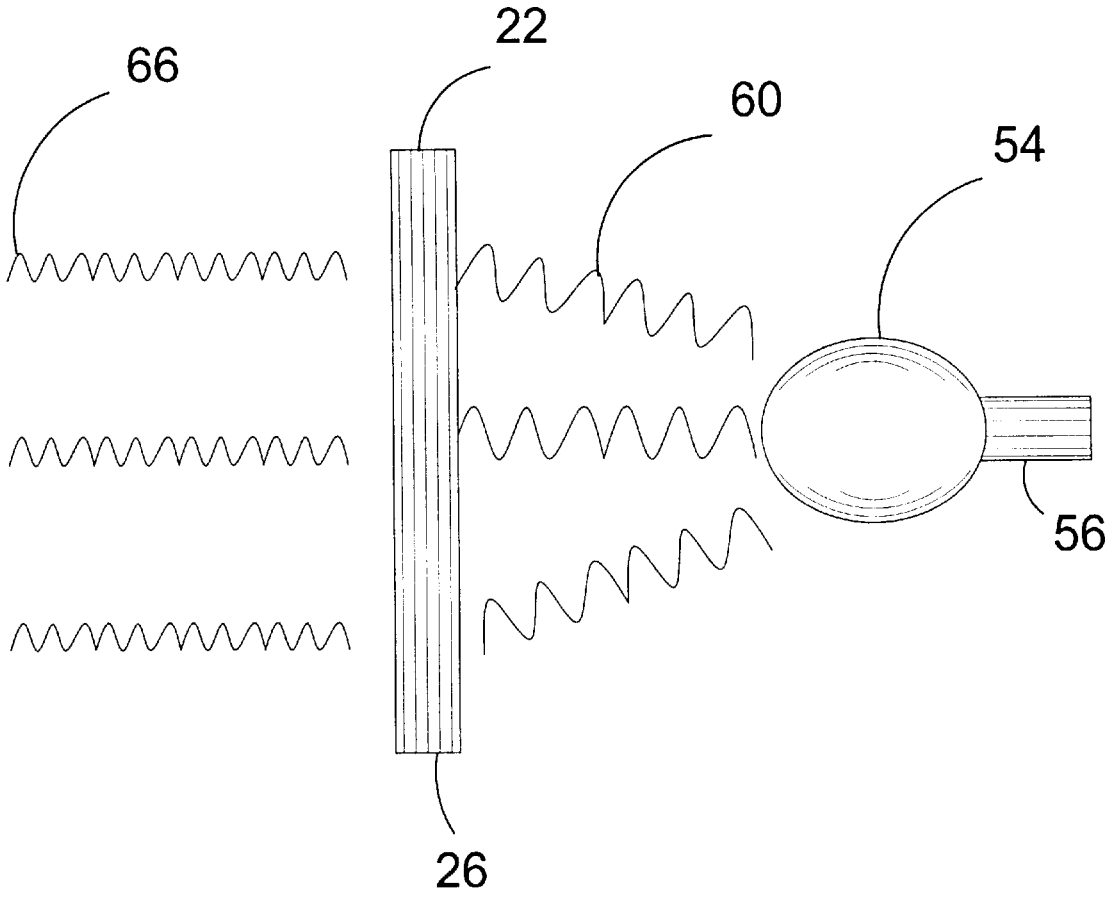
FIG. 6 is a side view of the light filtering film.

FIG. 6 is a side view of the light filtering film. Shown is a layer of the present invention having a red light source producing unfiltered red light waves directed toward the red tinted film layer wherein red light of only a particular preselected color and hue will be allowed to illuminate outward.

Figure 7:
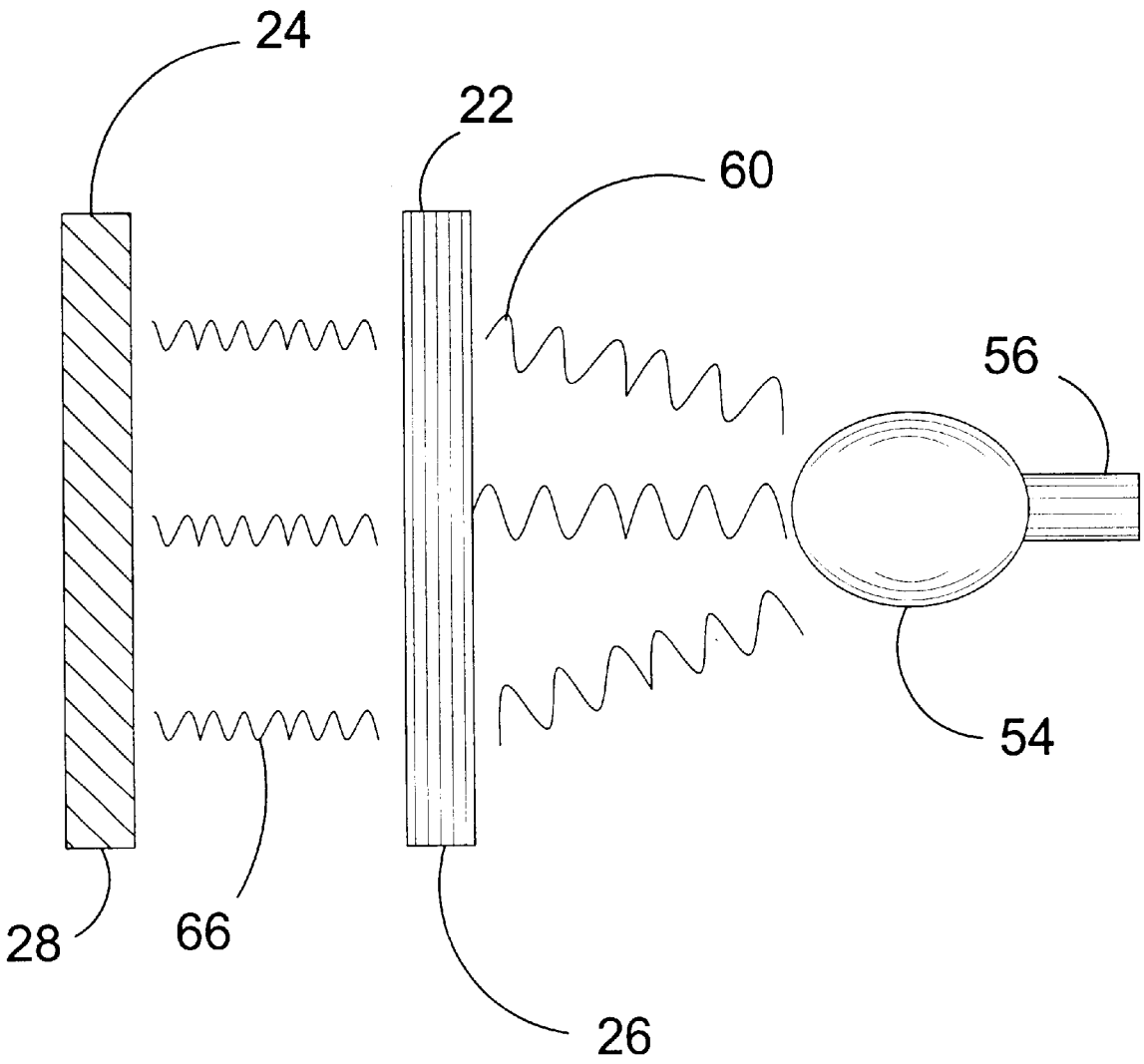
FIG. 7 is a side view of a plurality of light filtering films.

FIG. 7 is a side view of a plurality of light filtering films. Shown is a plurality of differently tinted film layers, showing unfiltered red light emitted by the red light source being filtered and allowed to pass through the red tinted film layer due to its conforming color hue, werethen the light allowed to illuminate through the red tinted film layer is restricted by the green tinted film layer because of differentiating color hue.

Figure 8:
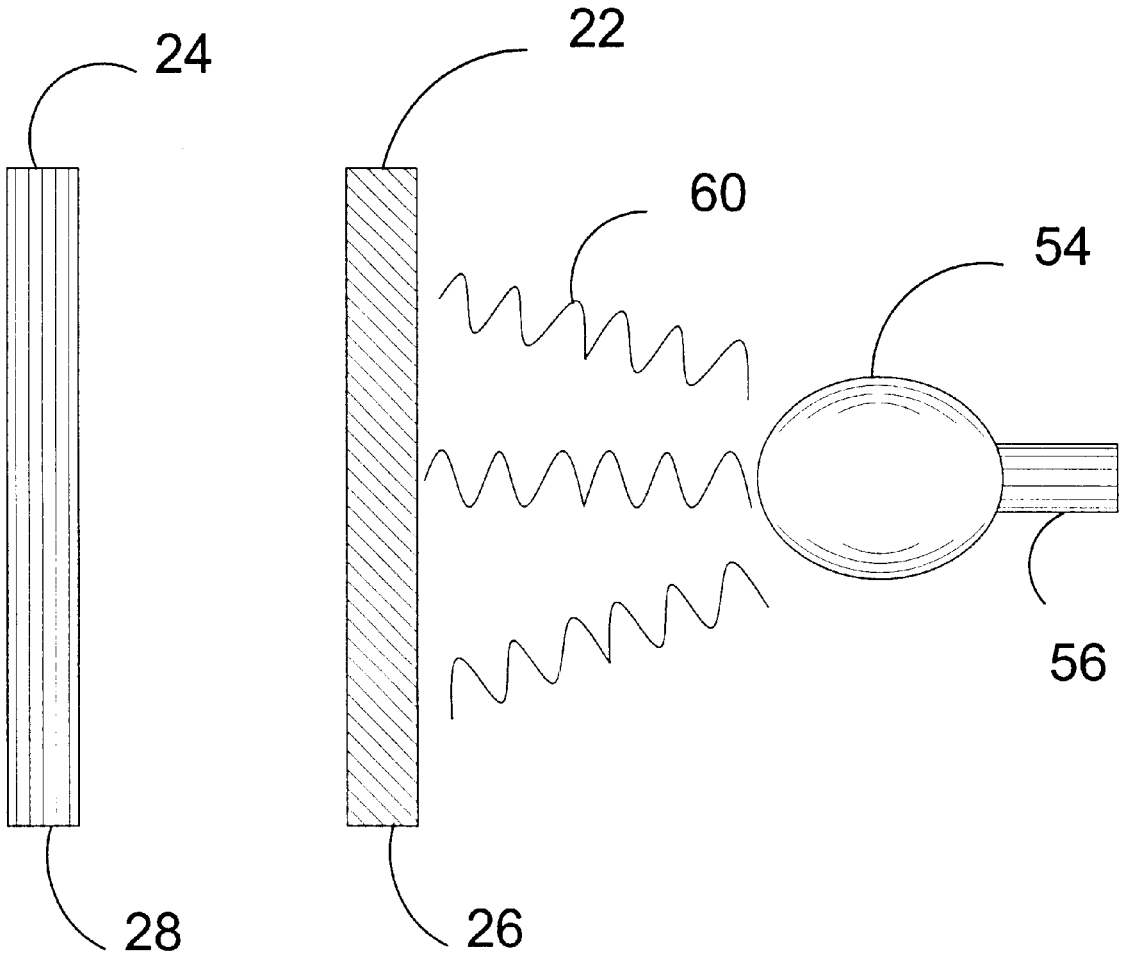
FIG. 8 is a side view of a plurality of light filtering films.

FIG. 8 is a side view of a plurality of light filtering films. Shown is a plurality of different colored film layers with a red light source emitting unfiltered red light directed toward a green tinted film layer with said emitted red light being restricted by the green tinted film layer from farther advancing to the red tinted film layer, due to its color hue differentiating from the green tinted film layers allowable hue.

Figure 9:
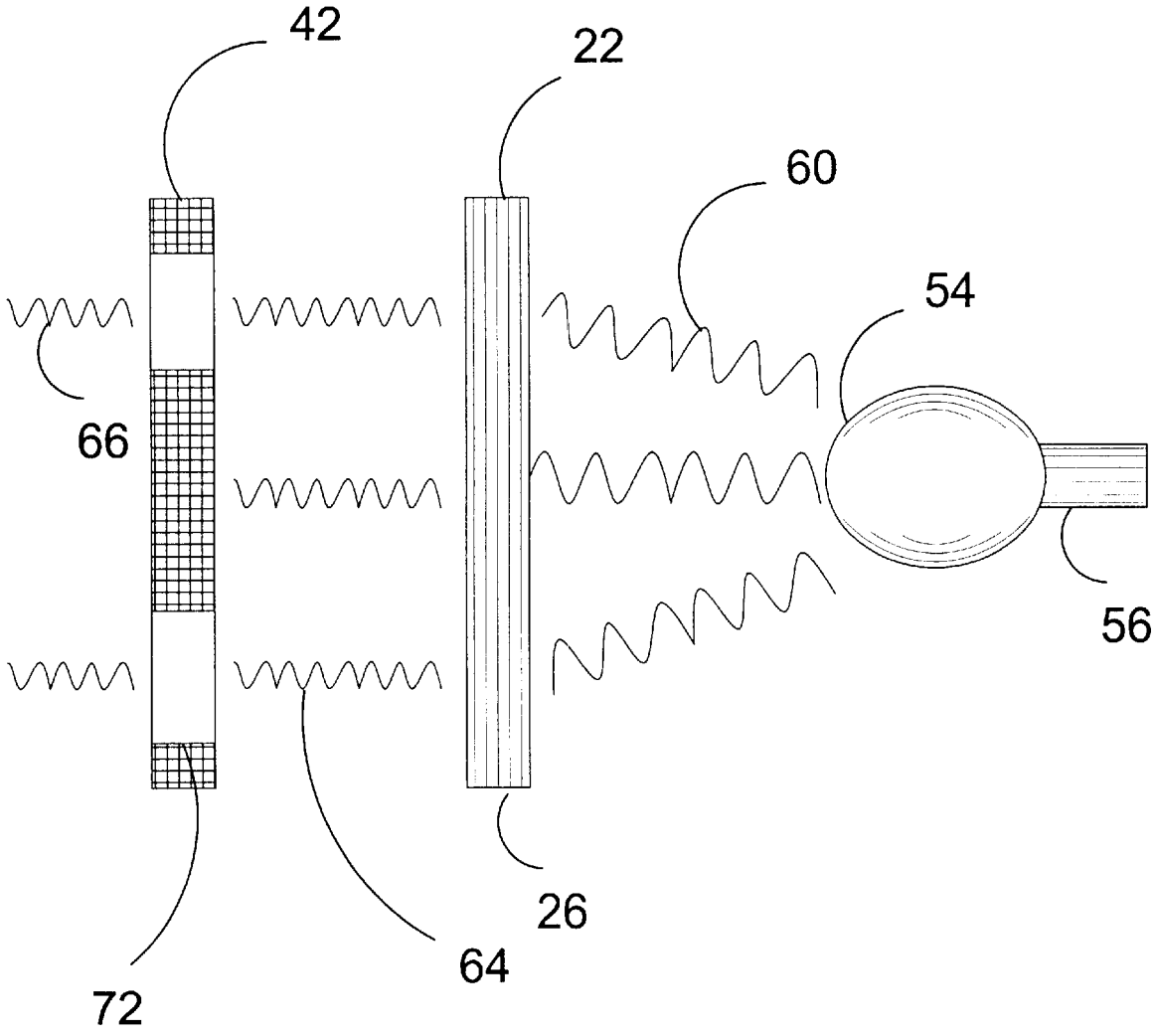
FIG. 9 is a side view of the present invention.

FIG. 9 is a side view of the present invention. Shown is the present invention having a layer of opaque material with apertures and a layer of color tinted film with a corresponding colored light source, showing that the light filtered and illuminated through the color tinted film is blocked by the opaque layer and only allowed to farther advance through its apertures.

Figure 10:
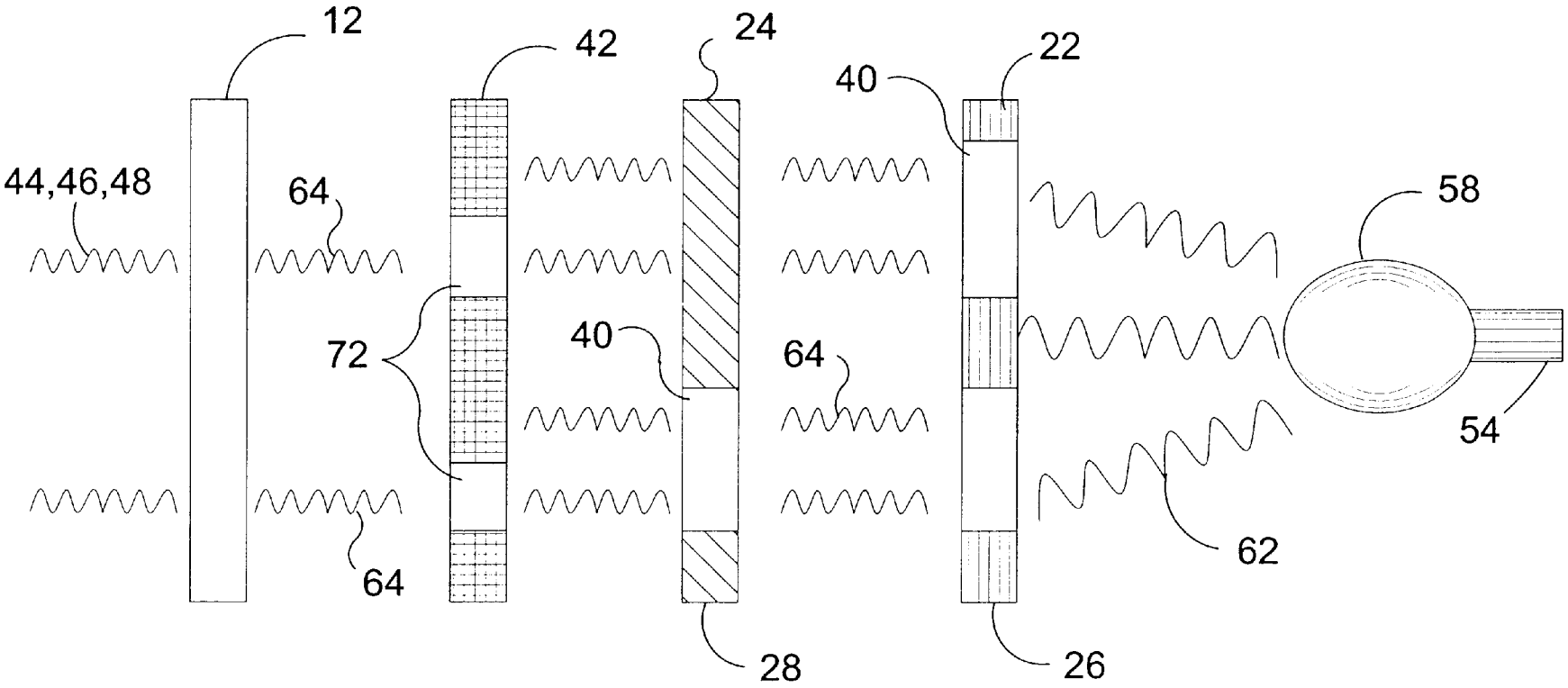
FIG. 10 is a front view of the present invention having compounded images.

FIG. 10 is a front view of the present invention having compounded images. Shown is the present invention having two differently colored film layers compounded and integrated into another and placed under a layer of opaque material with shaped apertures so that when differently colored light sources are applied behind the film a different image will be displayed corresponding with the light source and film's color. Also shown are overlapping cutouts wherein the portions viewable through the shaped apertures that have overlapping differently colored films, have been removed so that the two film layers do not block one another and instead allow for direct view of the colored light source.

Figure 11:
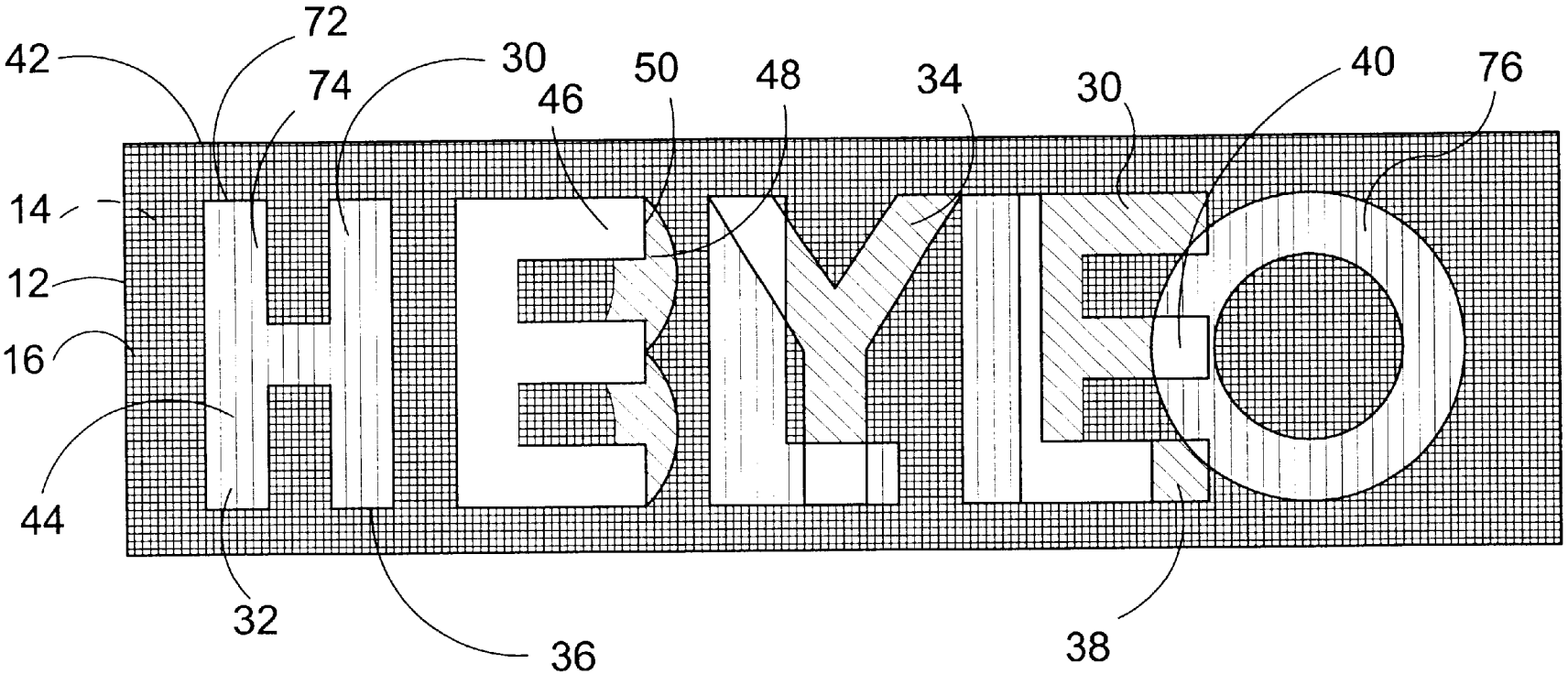
FIG. 11 is a perspective view of the present invention.

FIG. 11 is a perspective view of the present invention. Shown is the present invention with the a plurality of film layers compounded and integrated into one another with a red light source applying red light thereto, showing a preselected image being illuminated and displayed having a red hue created by the shape of the opaque layers apertures, the removal of overlapping film portions and light that is restricted by the green film layer. Also shown are all other areas appearing opaque.

Figure 12:
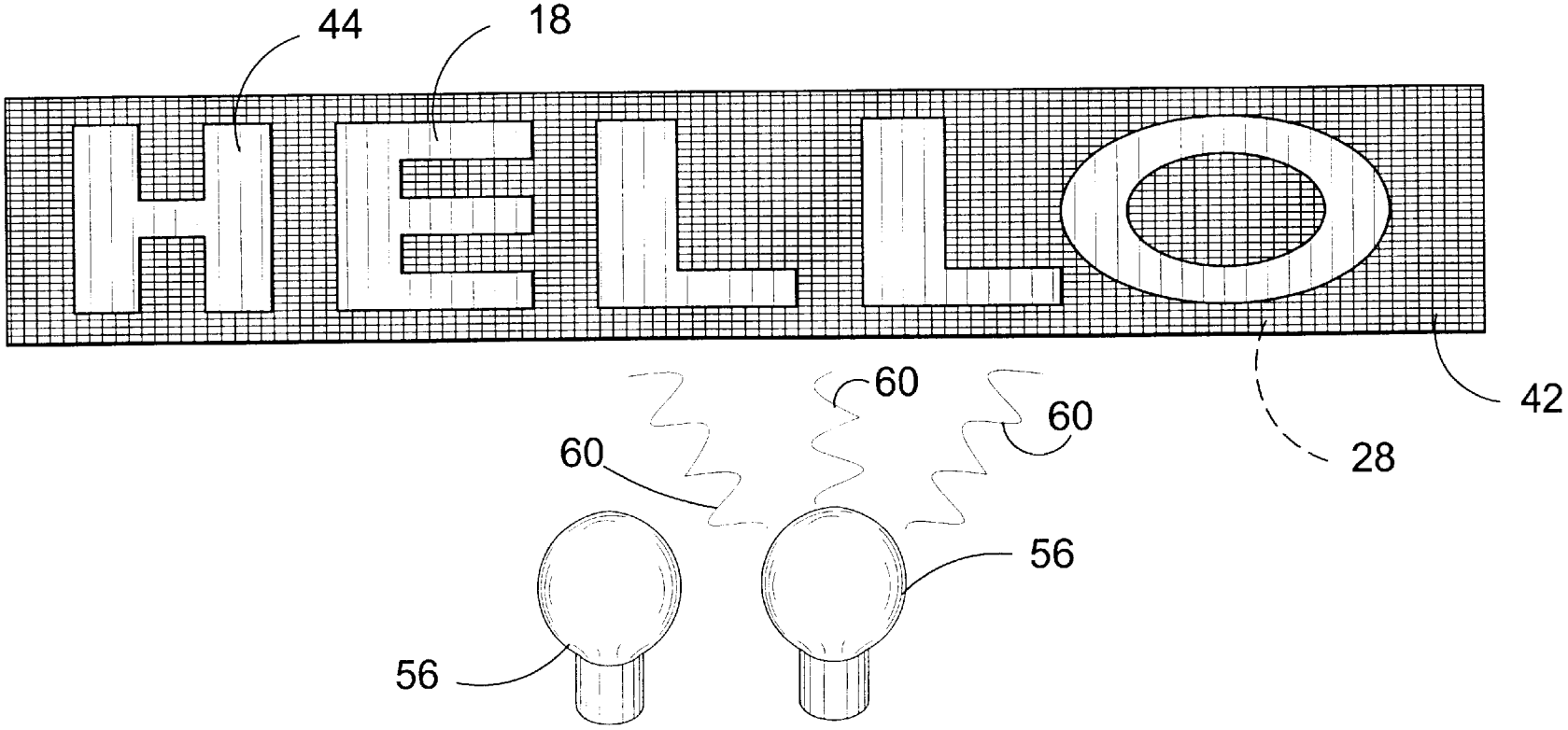
FIG. 12 is a perspective view of the present invention in operation.

FIG. 12 is a perspective view of the present invention in operation. Shown is the present invention with the a plurality of film layers compounded and integrated into one another with a green light source applying green light thereto, showing a preselected image being illuminated and displayed having a green hue created by the shape of the opaque layers apertures, the removal of overlapping film portions and light that is restricted by the red film layer. Also shown are all other areas appearing opaque.

Figure 13:
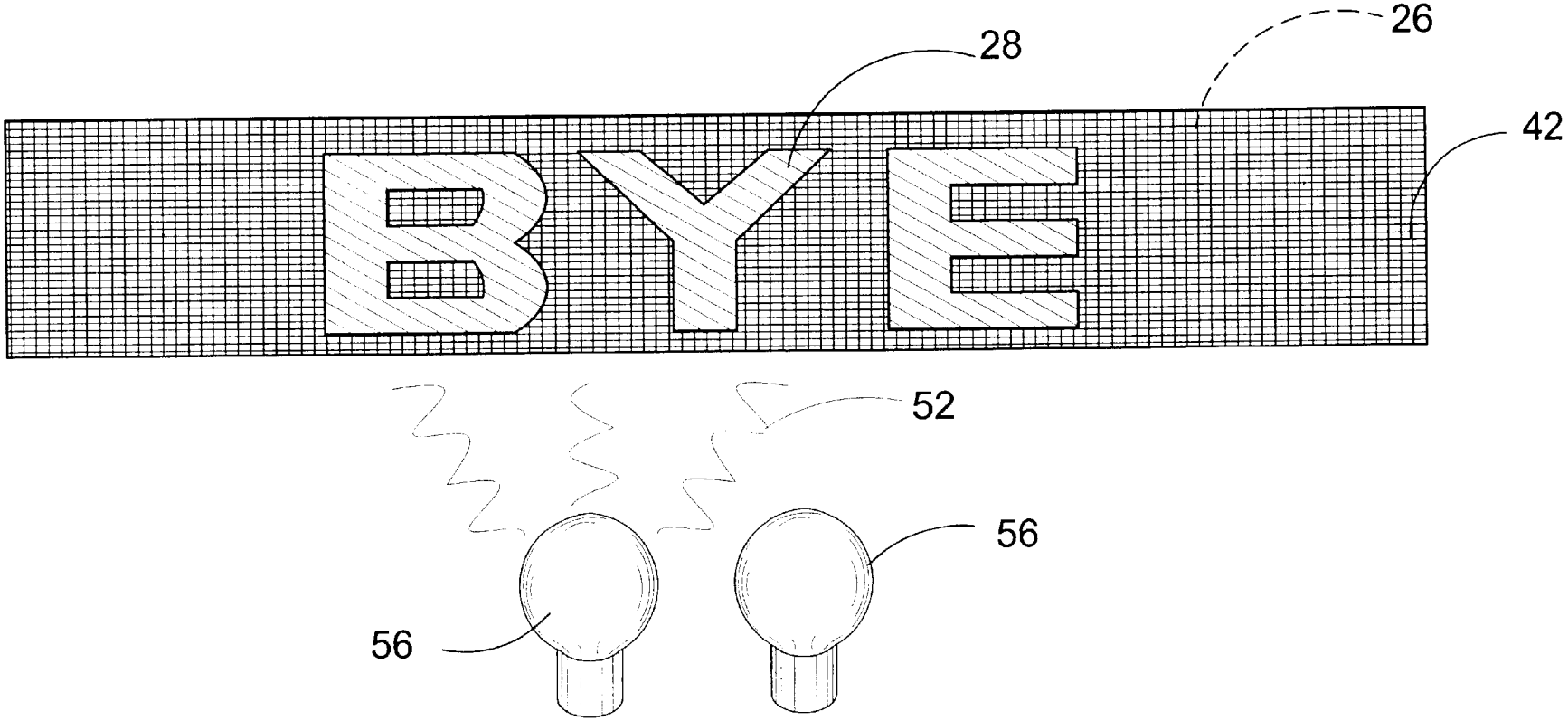
FIG. 13 is a side view of the present invention in operation.

FIG. 13 is a side view of the present invention in operation. Shown is the passage of light between the plurality of layers comprising the present invention when multiple colored film layers are used. Showing light being allowed to pass and be restricted in a number of manners, restricting manners being an opposingly tinted film layer or solid portions of the opaque layer, allowing manners being overlapping cutouts aligned with shaped apertures in the opaque layer or light corresponding tinted film layers with shaped apertures in the opaque layer.

What is claimed is new and desired to be protected by letters Patent is set forth in the appended claims:

1. An apparatus for displaying a selected image from a plurality of overlapping images comprising:

a) a transparent substrate for displaying an image projected thereon;

b) a transparent color filter for each image in series on one side of said transparent media, each filter being of a different color;

c) a layer of opaque material having overlapped groups of shaped apertures between said transparent substrate and the color filters, each group of apertures forming an image for display on said substrate; and d) a separate source of different colored light for each image, the sources of light being located as to direct beams of colored light through said color filters and the overlapped shaped groups of apertures in said opaque material onto said transparent substrate, only one light being energized at any one time in order to display on said transparent substrate a different image associated with the colored light of the source being energized and a group of apertures forming the image being displayed.

2. The apparatus of claim 1, wherein the sources of light include one of the following:

a) light emitting diodes (LED);

b) light bulbs having a filament; and c) charged gas light bulbs.

* * * * *